United States Patent [19]

Thayer

[11] 4,398,820

[45] Aug. 16, 1983

[54] CLEANING SYSTEM

[75] Inventor: Bruce E. Thayer, Webster, N.Y.

[73] Assignee: Xerox Corporation, Stamford, Conn.

[21] Appl. No.: 264,485

[22] Filed: May 18, 1981

[51] Int. Cl.[3] ..... G03G 21/00

[52] U.S. Cl. ..... 355/15; 15/256.51

[58] Field of Search ..... 355/3 R, 15; 15/1.5 R, 15/256.51, 256.52

[56] References Cited

U.S. PATENT DOCUMENTS

| | | | |
|---|---|---|---|
| Re. 28,566 | 10/1975 | Yang | 355/15 |
| 3,572,923 | 3/1971 | Fisher et al. | 355/15 |
| 3,637,976 | 1/1972 | Ohta et al. | 15/256.52 UX |
| 3,848,994 | 11/1974 | Fraser | 355/15 |
| 3,879,123 | 4/1975 | Fisher | 355/15 X |
| 3,884,572 | 5/1975 | Bacon et al. | 355/15 |
| 3,914,045 | 10/1975 | Namiki et al. | 355/15 |
| 4,006,987 | 2/1977 | Tomono et al. | 355/15 |
| 4,181,425 | 1/1980 | Higaya et al. | 355/15 |
| 4,252,433 | 2/1981 | Sullivan | 355/15 |
| 4,253,761 | 3/1981 | Takizawa et al. | 355/15 |
| 4,279,496 | 7/1981 | Silverberg | 355/16 X |

FOREIGN PATENT DOCUMENTS

| | | | |
|---|---|---|---|
| 7413260 | 12/1974 | Netherlands | 355/15 |

*Primary Examiner*—Fred L. Braun

*Attorney, Agent, or Firm*—H. Fleischer; J. E. Beck; R. Ziebelli

[57] ABSTRACT

A cleaning apparatus used in an electrophotographic printing machine for removing residual toner particles from a photoconductive member. The cleaning apparatus includes an electrically conductive roller in resilient engagement with the photoconductive member to define an extended cleaning region. A voltage source electrically biases the roller to attract the toner particles thereto in the extended cleaning region.

18 Claims, 4 Drawing Figures

CLEANING SYSTEM

This invention relates generally to an electrophotographic printing machine, and more particularly concerns an improved cleaning system for use therein.

In electrophotographic printing, a photoconductive member is charged to sensitize the surface thereof. The charged photoconductive member is exposed to a light image of an original document being reproduced. Exposure of the sensitized photoconductive member discharges the charge selectively. This records an electrostatic latent image on the photoconductive member corresponding to the informational areas contained within the original document being reproduced. Development of the electrostatic latent image recorded on the photoconductive member is achieved by bringing a developer material into contact therewith. Typical developer materials comprise a heat settable plastic powder, known in the art as toner particles, which adhere triboelectrically to coarser magnetic carrier granules, such as ferromagnetic granules. The toner particles are selected to have the appropriate charge relative to the electrostatic latent image recorded on the photoconductive member. When the developer material is brought into contact with the latent image recorded on the photoconductive member, the greater attractive force thereof causes the toner particles to transfer from the carrier granules to the electrostatic latent image.

Frequently, residual toner particles remain adhering to the photoconductive member after the transfer thereof to a sheet of support material. Hereinbefore, ordinary cleaning devices such as webs, brushes or foam rollers, have not been entirely satisfactory in cleaning residual toner particles from the photoconductive member. One of the more attractive methods for cleaning particles from the photoconductive member has been to use a rotating magnet enclosed in a stationary, non-magnetic shell, or, alternatively, to utilize stationary magnets enclosed within a rotating, non-magnetic shell. This system attracts carrier granules which, in turn, attract the residual toner particles from the photoconductive member thereto. One of the problems associated with a cleaning system of this type is that present designs are costly and somewhat complex in order to achieve the desired cleaning efficiency. Various techniques have been devised to overcome these problems. The following disclosures appear to be relevant:

U.S. Pat. No. 3,572,923
Patentee: Fisher et al.
Issued: Mar. 30, 1971
U.S. Pat. No. 3,848,994
Patentee: Fraser
Issued: Nov. 19, 1974
U.S. Pat. No. 3,884,572
Patentee: Bacon et al.
Issued: May 20, 1975
U.S. Pat. No. Re 28,566
Patentee: Yang
Issued: Oct. 7, 1975
U.S. Pat. No. 3,914,045
Patentee: Namiki et al.
Issued: Oct. 21, 1975
U.S. Pat. No. 4,252,433
Patentee: Sullivan
Issued: Feb. 24, 1981
U.S. Pat. No. 4,253,761

Patentee: Takizawa et al.
Issued: Mar. 3, 1981

The pertinent portions of the foregoing disclosures may be briefly summarized as follows:

Fisher et al. discloses a cleaning apparatus having a brush rotating from 1 to 1.5 times the speed of the photoconductive drum in a direction opposite thereto. The brush is electrically biased by a D.C. voltage source from about 500 volts to about 2,000 volts. A conductive roll positioned in contact with the brush is electrically biased to attract the toner particles therefrom. A D.C. voltage source electrically biases the conductive roll at a higher potential than that of the brush. The D.C. voltage may range from about 1,000 volts to about 3,000 volts. The conductive roll rotates from about the same speed as the brush to about double the brush speed. A cleaning blade contacts the conductive roll to remove toner particles therefrom. An auger assembly receives the toner particles removed from the conductive roll and moves the particles to a conduit for discharge and subsequent reuse in the development system.

Fraser describes a toner cleaning apparatus including a rotatably driven cylindrical cleaning brush engaging a photoreceptor imaging surface for removing toner particles therefrom. A continuously deformable pick-off roller having an electrically insulating outer surface, engages the brush. A scraping blade removes toner from the pick-off roller into an underlying adjacent auger assembly. Closely spaced conductive elements on the surface of the pick-off roller are differently electrically biased to create a plurality of non-uniform electrostatic fields between adjacent conductive elements. The fringe fields are electrically attractive to all of the toner particles regardless of their charge.

Bacon et al. discloses a cleaning apparatus which includes a wiper roller for removing toner particles from a photoreceptor. The wiper roller has an outer layer of conductive material and a conductive metallic core made of aluminum or hardened steel. A scavenging roller engages the wiper roller to remove toner particles therefrom. A blade scrapes the scavenging roller to remove the toner particles therefrom. The scavenging roller is a conductive steel roller grounded at a current source. The current source is connected through the scavenging roller to the outer skin of the wiper roller.

Yang describes a cleaning apparatus including a cylindrical member having magnets disposed interiorly thereof. A magnetic cleaning material is arranged on the surface of the cylinder. The cylinder is electrically biased by a D.C. voltage source to a potential ranging from about 200 volts to about 1,000 volts. As the cylindrical member rotates, streamers of cleaning material contact the photoreceptor to triboelectrically remove toner particles therefrom. A conductive roller electrically biased to a D.C. potential ranging from about 1,000 volts to about 2,000 volts contacts the magnetic cleaning material to attract the toner particles therefrom. A scraper blade contacts the conductive roller to remove the toner particles from the surface thereof.

Namiki et al. discloses an electrically grounded roller for precleaning a residual image from a photoreceptor prior to the final cleaning by the same magnetic brush used in developing the electrostatic latent image recorded on the photoreceptor. The conductive roller contacts the photoreceptor and is electrically grounded. A wiper is in sliding contact with the roller.

Sullivan discribes an apparatus for cleaning a residual image from a photoconductive drum. The cleaning apparatus has a blade contacting the photoconductive drum to scrape the toner particles therefrom. A conductive roller is electrically biased by a D.C. voltage source to attract toner particles removed by the blade. A scraper blade contacts the conductive roller to remove the toner particles adhering thereto. These toner particles are then discharged from the sump of the cleaning housing by an auger.

Takizawa et al. discloses a cleaning device including a roller made from a thick resilient material. The roller is resiliently urged into engagement with the photoconductive drum. The roller triboelectrically attracts toner particles from the drum. A blade scrapes toner particles from the roller. Rubbing between the roller, drum and blade produces the required triboelectric charge on the roller to attract the toner particles thereto.

In accordance with the features of the present invention, there is provided an apparatus for removing residual particles from a member. The apparatus includes means, in resilient engagement with the member to define a cleaning region therebetween, for transporting the particles away from the member. Means are provided for electrically biasing the transporting means to attract the particles from the member to the transporting means.

Other aspects of the present invention will be apparent as the following description proceeds and upon reference to the drawings, in which.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
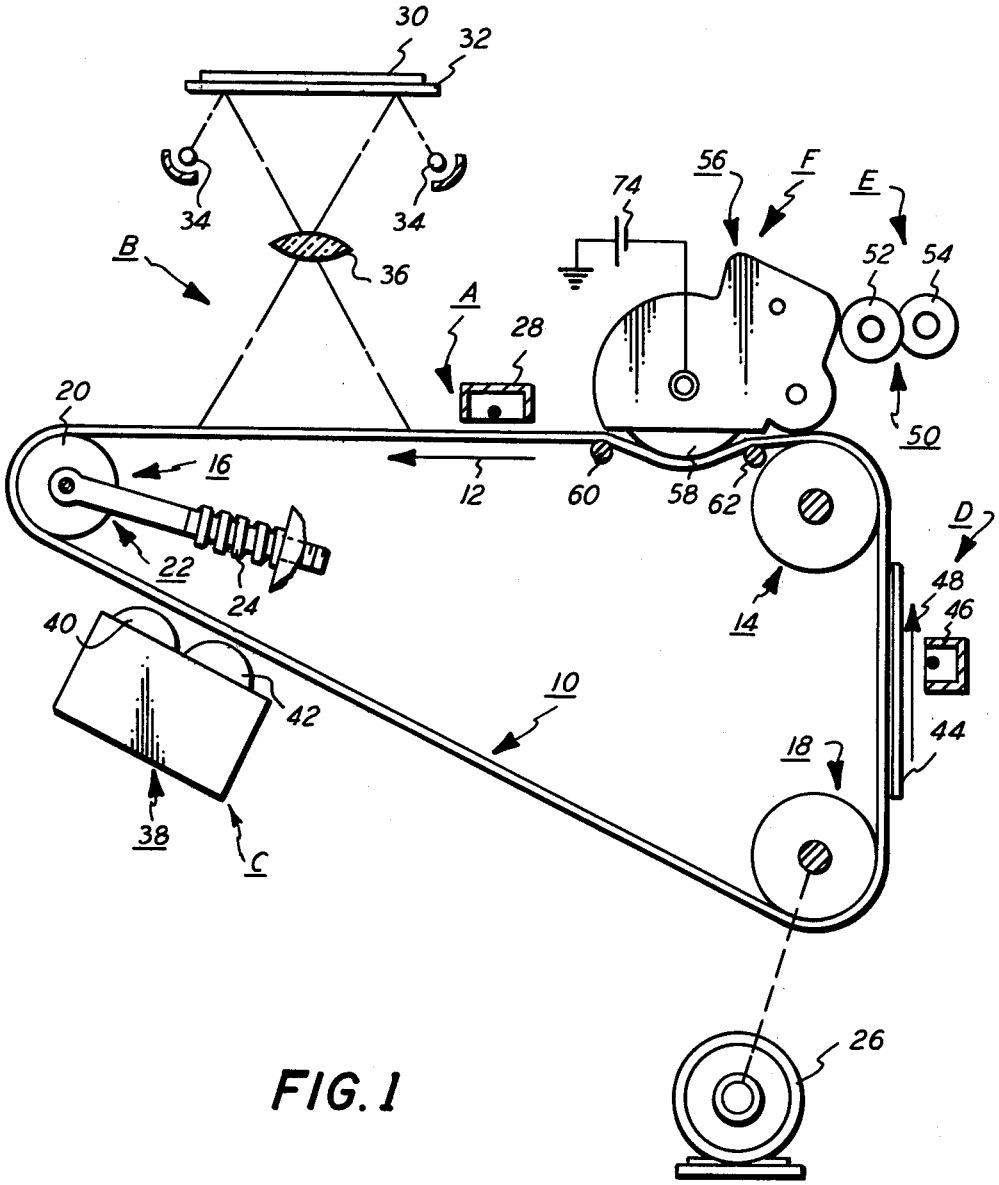
FIG. 1 is a schematic elevational view depicting an illustrative electrophotographic printing machine incorporating the features of the present invention therein.

For a general understanding of the illustrative electrophotographic printing machine incorporating the features of the present invention, reference is made to the drawings. In the drawings, like reference numerals have been used throughout to designate identical elements. FIG. 1 schematically depicts the various components of an electrophotograhic printing machine employing the cleaning system of the present invention therein. Although this cleaning system is particularly well adapted for use in an electrophotographic printing machine having a flexible photoconductive belt, it will become evident from the following discussion that it is equally well suited for use in an electrophotographic printing machine employing a rigid photoconductive drum as well as a wide variety of other electrostatographic printing machines and is not necessarily limited in its application to the particular embodiments shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy with the conductive substrate being made from aluminum. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16 and drive roller 18. As depicted in FIG. 1, tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is placed face down upon a transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic brush development system, indicated generally by the reference numeral 38, advances a developer material into contact with the electrostatic latent image recorded on the photoconductive surface of belt 10. Preferably, magnetic brush development system 38 includes developer rollers 40 and 42. Developer rollers 40 and 42 transport a brush of developer material comprising magnetic carrier granules and toner particles into contact with belt 10. The electrostatic latent image recorded on the photoconductive surface of belt 10 attracts the toner particles from the carrier granules forming a toner powder image thereon.

After development, belt 10 advances the toner powder image to transfer station D. At transfer station D, a sheet of support material 44 is moved into contact with the toner powder image. Sheet of support material 44 is advanced to transfer station D by a sheet feeding apparatus (not shown). Preferably, the sheet feeding apparatus includes a feed roll contacting the uppermost sheet of the stack of sheets. The feed roll rotates so as to advance the uppermost sheet from the stack into a chute. The chute directs the advancing sheet of support material into contact with the photoconductive surface of belt 10 in a timed sequence so that the powder image developed thereon contacts the advancing sheet of support material at transfer station D.

Transfer station D includes a corona generating device 46 which sprays ions onto the backside of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the transferred toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder is permanently affixed to sheet 44. After fusing, a chute guides advancing sheet 44 to a catch tray for subsequent removal from the printing machine by an operator.

Invariably, after the sheet of support material is separated from the photoconductive surface of belt 10, some residual toner particles remain adhering thereto. These particles are cleaned from the photoconductive surface of belt 10 at cleaning station F. Preferably, cleaning station F includes a cleaning system, indicated generally by the reference numeral 56, which attracts toner particles from the photoconductive surface of belt 10 thereto. Cleaning system 56 includes a cleaning roller 58 which attracts residual toner particles from the photoconductive surface of belt 10 thereto. As shown in FIG. 1, roller 58 deflects belt 10 in an arc so as to produce an extended cleaning region between idler rollers 60 and 62. The detailed structure of cleaning system 56 will be described hereinafter with reference to FIGS. 3 and 4. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
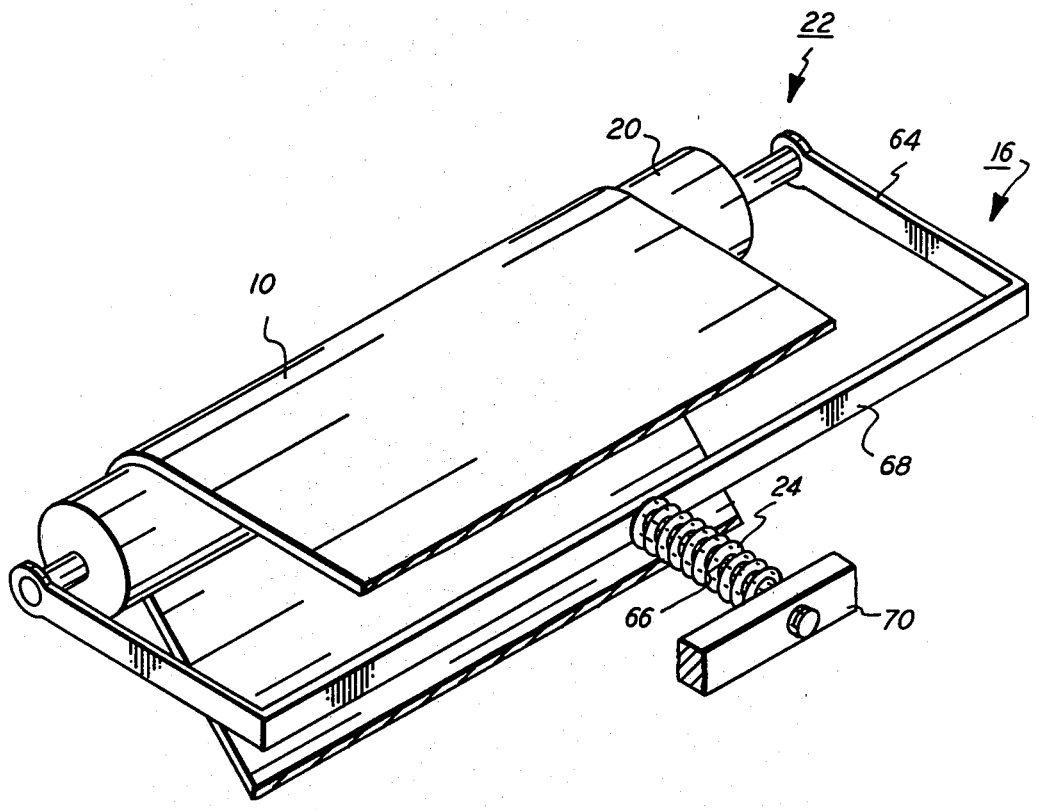
FIG. 2 is a fragmentary, perspective view showing the belt tensioning arrangement of the FIG. 1 printing machine.

Referring now to the specific subject matter of the present invention, FIG. 2 depicts tensioning system 16 in greater detail. As shown thereat, tensioning system 16 includes a roller 20 having a belt 10 passing thereover. Roller 20 is mounted on suitable bearings within a yoke, indicated generally by the reference numeral 22. Preferably, yoke 22 includes a U-shaped member 64 supporting roller 20 and a rod 66 secured to the midpoint of cross member 68 of U-shaped member 64. A coil spring 24 is wrapped around rod 66. Rod 66 is mounted slidably in the printing frame 70. Coil spring 24 is compressed between cross member 68 and frame 70. Compressed spring 24 resiliently urges yoke 22 and, in turn, roller 20 against belt 10. Belt 10 is maintained under a sufficiently low tension to enable roller 58 (FIG. 3) of cleaning system 56 to deflect belt 10 through an arc ranging from about 10° to about 40°.

Figure 3:
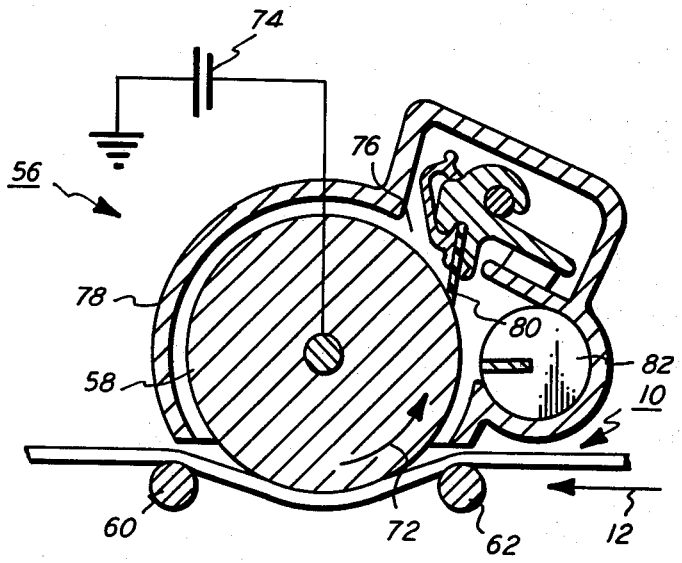
FIG. 3 is an elevational view depicting one embodiment of a cleaning system for use in the FIG. 1 printing machine.

FIG. 3 depicts cleaning system 56 in greater detail. As shown thereat, cleaning system 56 includes a roller 58. Preferably, roller 58 is smooth. An insulating layer may be applied to the exterior circumferential surface thereof. By way of example, stainless steel and anodized aluminum rolls are suitable. Roller 58 rotates in the direction of arrow 72. Thus, the tangential velocity of roller 58, in the cleaning region, is opposed to the tangential velocity of belt 10, as indicated by arrow 12. Preferably, the magnitude of the tangential velocity of roller 58 ranges from being about equal to the magnitude of the tangential velocity of belt 10 to about twice the magnitude of the tangential velocity of belt 10. Voltage source 74 is electrically connected to roller 58. In this way, voltage source 74 electrically biases roller 58 to a suitable polarity and magnitude so as to attract residual toner particles from photoconductive belt 10 thereto. By way of example, voltage source 74 may electrically bias roller 58 to a voltage ranging from about 100 volts to about 200 volts. Roller 58 is mounted rotatably within chamber 76 of housing 78. Scrapping blade 80 has one end thereof secured to housing 78. The other end of scraping blade 80 is in engagement with roller 58. In this way, toner particles adhering to the surface of roller 58 are removed therefrom by scraping blade 80. Thus, as roller 58 rotates in the direction of arrow 72, the toner particles are scraped therefrom and descend downwardly in chamber 76 of housing 78. Auger 82 has one end portion thereof in chamber 76 of housing 78. The other end portion thereof is at a remote location, e.g. development station C. By way of example, auger 82 may include a helical coil disposed within a flexible tube having apertures in housing 78 to receive the residual toner particles therein. As the helical coil rotates, the residual toner particles are advanced along the tube to the development station. Alternatively, the toner particles may be advanced to a position remote from the printing machine. Preferably, auger 82 is flexible. In this way, the residual toner particles are collected and advanced away from cleaning system 56. Roller 58 is in resilient engagement with photoconductive belt 10 so as to define an extended cleaning region between idler rolls 60 and 62 optimizing removal of toner particles from belt 10. Thus, in the embodiment depicted herein, belt 10 is flexible and roller 58 substantially rigid. Alternatively, the photoconductive member may be rigid and the cleaning roller resilient. Such a configuration is depicted in FIG. 4.

Figure 4:
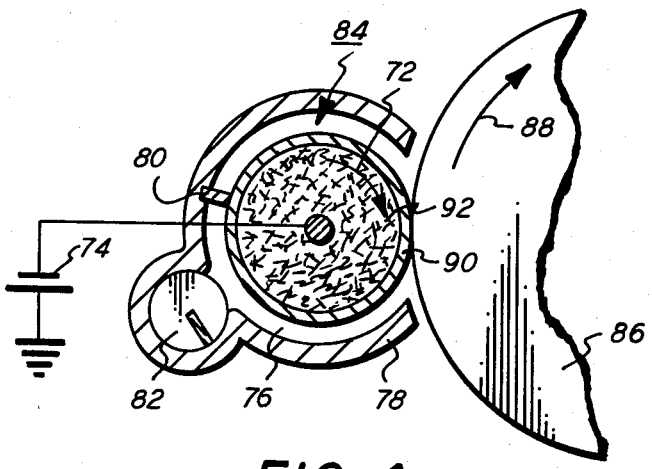
FIG. 4 is an elevational view showing another embodiment of a cleaning system for use in an electrophotographic printing machine having a rigid photoconductive member.

Turning now to FIG. 4, cleaning system 56 includes a roller, indicated generally by the reference numeral 84. Roller 84 is in resilient engagement with photoconductive drum 86. Drum 86 rotates in the direction of arrow 88. Roller 84 rotates in the direction of arrow 72. Once again, the magnitude of the tangential velocity of roller 84 ranges from being about equal to the magnitude of the tangential velocity of drum 86 to being about twice the magnitude of the tangential velocity thereof. Roller 84 is resilient and deforms to form an extended cleaning zone. The extended cleaning zone is in the region wherein roller 84 engages drum 86. Preferably, roller 84 includes a metal nickel sleeve 90 having elastomeric roller 92 disposed interiorly thereof. By way of example, sleeve 90 may be electroformed nickel with roller 92 being made from a foam material. As previously indicated with regard to the embodiment depicted in FIG. 3, voltage source 74 electrically biases roller 84 to a suitable polarity and magnitude so as to attract residual toner particles from photoconductive drum 86. The residual toner particles are scraped from roller 84 by blade 80 having one edge thereof in engagement therewith. These residual toner particles fall into chamber 76 of housing 78. As these particles descend in chamber 76, auger 82 advances the toner particle from chamber 76 to a remote location.

It is clear that the cleaning system of the present invention is compatible with a seamed photoconductive belt. Moreover, a dry lubricant in the developer material is not required since the roll and scraping blade materials can be chosen for compatibility, e.g. both a metallic roll and blade may be employed. Furthermore, toner reclamation is feasible. In addition, there are no critical spacings in the system and maintenance is minimized.

In recapitulation, it is evident that the cleaning system of the present invention includes an electrically biased roller in resilient engagement with a photoconductive member so as to remove residual toner particles therefrom. A system of this type minimizes cost and complexity.

It is, therefore, apparent that there has been provided in accordance with the present invention, an apparatus for cleaning residual particles from a photoconductive member that fully satisfies the advantages and aims hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An electrophotographic printing machine of the type having residual toner particles adhering to a photoconductive member, wherein the improvement includes:

electrically conductive means, in resilient engagement with the photoconductive member to define an extended cleaning region therebetween, for transporting the toner particles away from the photoconductive member; and means for electrically biasing said transporting means to attract the toner particles from the photoconductive member to said transporting means in the extended cleaning region.

2. A printing machine according to claim 1, wherein said transporting means includes a roller.

3. A printing machine according to claim 2, wherein the photoconductive member is a flexible belt.

4. A printing machine according to claim 2, wherein the photoconductive member is a substantially rigid drum.

5. A printing machine according to claims 3 or 4, wherein said roller has a tangential velocity opposite in direction to the tangential velocity of the photoconductive member.

6. A printing machine according to claim 5, wherein the magnitude of the tangential velocity of said roller ranges from being about equal to the magnitude of the tangential velocity of the photoconductive member to about twice the magnitude of the tangential velocity of the photoconductive member.

7. A printing machine according to claims 3 or 4, wherein said biasing means includes a voltage source coupled to said roller.

8. A printing machine according to claim 7, wherein said voltage source electrically biases said roller to a voltage ranging from about 100 volts to about 200 volts.

9. A printing machine according to claims 3 or 4, further including means for scraping the toner particles from said roller.

10. A printing machine according to claim 9, wherein said scraping includes a blade having an edge thereof contacting said roller.

11. A printing machine according to claim 10, further including means for collecting the toner particles scraped from said roller and advancing the removed toner particles to a location remote from said roller.

12. A printing machine according to claim 11, wherein said collecting and advancing means includes:

a housing defining a chamber having said roller and said blade mounted therein for collecting the toner particles removed from said roller; and a flexible auger for advancing the toner particles from the chamber of said housing to the location remote therefrom.

13. A printing machine according to claim 3, wherein said roller is substantially rigid.

14. A printing machine according to claim 3, wherein said roller is made preferably from aluminum.

15. A printing machine according to claim 14, wherein said aluminum roller includes an insulating layer on the exterior circumferential surface thereof.

16. A printing machine according to claim 13, wherein said roller is made preferably from steel.

17. A printing machine according to claim 13, wherein said roller is resilient.

18. A printing machine according to claim 17, wherein said resilient roller includes:

an elastomeric roller; and a metal sleeve having said elastomeric roller disposed interiorly thereof.

* * * * *